US010316477B2

(12) United States Patent
Reufels

(10) Patent No.: US 10,316,477 B2
(45) Date of Patent: Jun. 11, 2019

(54) SCREED ASSEMBLY WITH AUTOMATIC START-STOP SYSTEM

(71) Applicant: JOSEPH VOEGELE AG, Ludwigshafen/Rhein (DE)

(72) Inventor: Harald Reufels, Vettelschoss (DE)

(73) Assignee: JOSEPH VOEGELE AG, Ludwigshafen/Rhein (DE)

( * ) Notice: Subject to any disclaimer, the term of this patent is extended or adjusted under 35 U.S.C. 154(b) by 2 days.

(21) Appl. No.: 15/447,574

(22) Filed: Mar. 2, 2017

(65) Prior Publication Data

US 2017/0254030 A1 Sep. 7, 2017

(30) Foreign Application Priority Data

Mar. 2, 2016 (EP) ..... 16158293

(51) Int. Cl.
*E01C 19/48* (2006.01)
*E01C 19/22* (2006.01)

(52) U.S. Cl.
CPC ..... *E01C 19/48* (2013.01); *E01C 19/22* (2013.01)

(58) Field of Classification Search
CPC ..... E01C 19/48; E01C 19/22
See application file for complete search history.

(56) References Cited

U.S. PATENT DOCUMENTS 7,591,608 B2 * 9/2009 Hall ..... E01C 19/22 404/133.05
8,454,266 B2 6/2013 Buschmann et al.
8,894,323 B2 11/2014 Rutz et al.
9,068,295 B2 6/2015 Rutz et al.
9,447,549 B2 9/2016 Buschmann et al.
2008/0003057 A1 1/2008 Hall et al.
(Continued)

FOREIGN PATENT DOCUMENTS

CN 104101434 A 10/2014
EP 2366831 A1 9/2011
(Continued)

OTHER PUBLICATIONS

European Search Report dated Jun. 24, 2016, Application No. EP 16158293.7-1604, Applicant Joseph Voegele AG, 7 Pages.
(Continued)

*Primary Examiner* — Abigail A Risic
(74) *Attorney, Agent, or Firm* — Brooks Kushman P.C.

(57) ABSTRACT

A screed assembly is provided for use at a road finisher. This comprises a control unit, a first compacting device and a second compacting device, which is arranged in a first direction behind the first compacting device. The disclosure is characterized in that the control unit is configured to activate and/or deactivate the second compacting device in a delayed manner relative to the first compacting device by a time period, which is unequal to zero. A method for operating a screed assembly for use at a road finisher is also provided. This comprises the following steps: activating and/or deactivating a first compacting device of the screed assembly, activating and/or deactivating a second compacting device of the screed assembly, which is arranged in direction of travel of the road finisher behind the first compacting device, after expiration of a predeterminable time period, which is unequal to zero.

21 Claims, 6 Drawing Sheets

(56) References Cited

U.S. PATENT DOCUMENTS

| | | | | |
|---|---|---|---|---|
| 2010/0329783 | A1 | 12/2010 | Weiser et al. | |
| 2012/0263531 | A1* | 10/2012 | Rutz | E01C 19/00 404/72 |
| 2014/0133906 | A1* | 5/2014 | Frelich | E01C 19/48 404/75 |
| 2015/0139729 | A1 | 5/2015 | Graham et al. | |
| 2015/0337503 | A1* | 11/2015 | Smieja | E01C 19/40 404/102 |
| 2017/0178428 | A1* | 6/2017 | Watermann | G07C 5/0825 |

FOREIGN PATENT DOCUMENTS

| | | | |
|---|---|---|---|
| EP | 2514871 | A1 | 10/2012 |
| EP | 2514872 | A1 | 10/2012 |
| JP | 50-133611 | A | 10/1975 |
| JP | 2012-165736 | A | 9/2012 |

OTHER PUBLICATIONS

Japanese Notice of Allowance dated Jan. 12, 2018, Application No. 2017-036545, Applicant: Joseph Fegere AGE, 3 Pages.

Chinese Office Action dated Dec. 26, 2018, Application No. 201710117523.8, 7 Pages.

* cited by examiner

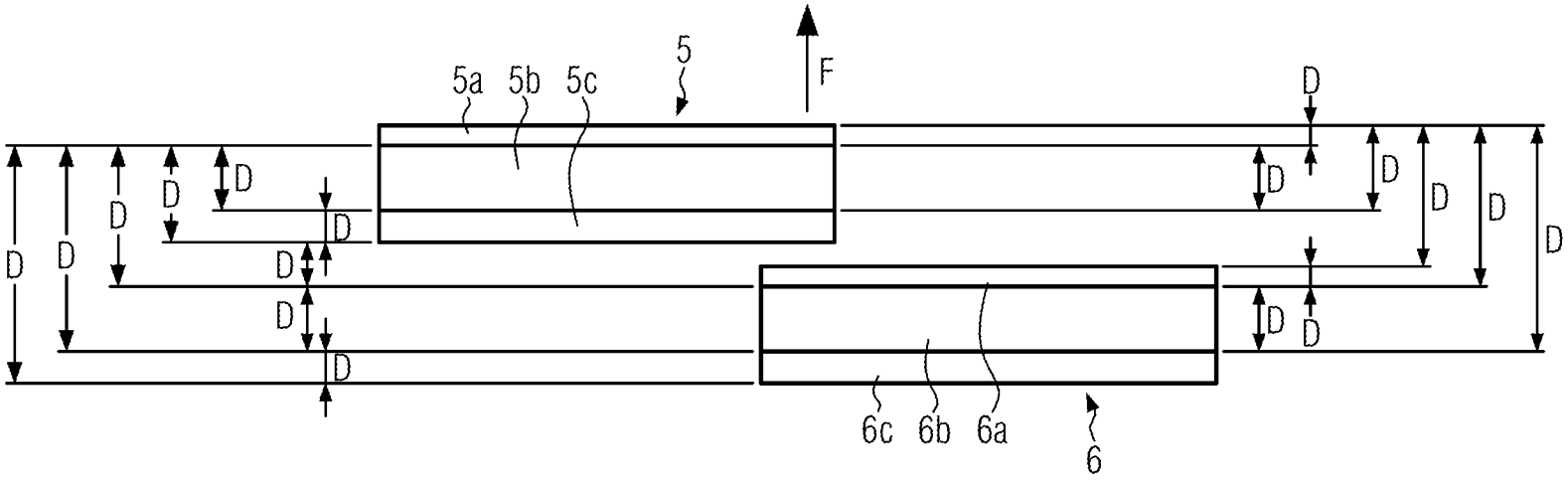
D
D
D

SCREED ASSEMBLY WITH AUTOMATIC START-STOP SYSTEM

CROSS-REFERENCE TO RELATED APPLICATIONS

This application claims foreign priority benefits under 35 U.S.C. § 119(a)-(d) to European patent application number EP 16158293.7, filed Mar. 2, 2016, which is incorporated by reference in its entirety.

TECHNICAL FIELD

The disclosure relates to a screed assembly for use on a road finisher. Furthermore, the disclosure relates to a method for operating such a screed assembly.

BACKGROUND

Screed assemblies for road finishers are known from practice. They are used for smoothing and compacting asphalt mixed material. For this purpose, they are pulled by a tractor unit of a road finisher. In case of modern road finishers, the screed assembly is generally pulled floating; this means that the screed is resting on the material to be smoothened and compacted and that the flotation and consequently, the thickness of the installed road surface are essentially adjusted by the pitch angle of the screed and the pulling speed.

It is known that one or more compacting devices are provided at screeds. Screed assemblies of the applicant comprise for example tamper bars, vibration units and/or pressure bars in various combinations.

Furthermore, screed assemblies comprising several screed segments are known. These for example can be extending segments of screeds, by extending of which, the working width of the screed assembly may be enlarged. Rigid attachment parts are likewise known.

At the beginning of an installation run, initially, the screed assembly is usually placed at a start point. This may be an aid, such as a wooden beam, on which the screed assembly is placed before the installation run starts. It may also be a straightly cut edge of an already existing asphalt surface layer, on which the asphalt layer to be newly installed is to be applied.

It may occur that several compacting units are arranged one behind the other in the direction of travel of the road finisher and consequently pass the transition between the aid or the straightly cut edge and the newly laid asphalt mix material one after the other. This may for example be a result of the fact that several compacting devices are arranged one behind the other on one and the same screed segment, or that screed segments with one or more compacting devices, respectively, are arranged one behind the other. Conventional road finishers simultaneously activate all compacting devices. In the event that all compacting devices are activated at the point in time, when the first compacting device passes the transition, this leads to the fact that the compacting devices, which have not yet passed the transition, strike the aid or the already hardened preceding asphalt layer and, thus, the existing asphalt layer or the compacting devices are damaged. In cases, in which all compacting devices are only activated, if all compacting devices have passed the transition, the initial sections of the newly laid surface remain unprocessed by the previous compacting devices. As recognized by the inventor, this may lead to inhomogeneities and, consequently, to variations in quality in the finished surface.

SUMMARY

It is an object of the disclosure to improve by measures that are constructively as simple as possible existing screed assemblies in such a way that a continuous quality of the asphalt layer is ensured and that the risk of damage or even destruction of machine components or already laid asphalt is minimized.

The screed assembly according to the disclosure for use at a road finisher comprises a control unit, a first compacting device, and a second compacting device, which is arranged in a first direction behind the first compacting device. The screed assembly according to the disclosure is characterized in that the control unit is configured to activate and/or deactivate the second compacting device in a delayed manner relative to the first compacting device by a time period, which is unequal to zero. Both, the first as well as the second compacting device may be for example one or more tamper bars, vibration units and/or pressure bars. The first direction may in particular be the direction of travel of the road finisher. The first and the second compacting device may be provided on one and the same screed segment. It is also conceivable that the first compacting device is provided on a first screed segment, for example a basic screed, and the second compacting device on a second screed segment, for example an extending screed or an attachment and/or a broadening part.

It is conceivable that the screed assembly comprises a first screed segment and a second screed segment, wherein the second screed segment is arranged in the first direction behind the first screed segment, wherein the first screed segment comprises the first compacting device and the second screed segment comprises the second compacting device. The first and the second screed segment, in which each screed segment may have at least one compacting device, may also lie in one line, as is the case for a rigid screed.

However, also embodiments are conceivable, in which two or several screed segments are arranged next to one another in the direction of travel. In this case, the screed segments may be arranged in alignment with one another. In such an embodiment, the screed segments can simultaneously pass the installation start or the installation end. In cases, in which the screed segments arranged in this way are provided with the same compacting devices, these can also be arranged in alignment with one another. It is then advantageous, if a compacting device of the first screed segment is activated simultaneously with the compacting device/s, which is/are arranged in alignment with this compacting device on the second and/or further screed segment/s. In case of two screed segments, for example, compacting device pairs lying behind each other may be consecutively activated. The screed segments may be provided in one and the same rigid (i.e., non-extendable) basic screed, may be arranged on a rigid basic segment and on rigid or extendable attachment parts fixed thereto, or may be arranged on an extendable basic screed and to attachment parts fixed thereto.

A sensor unit may be provided, which is configured to detect the installation start and/or the installation end. This allows a further automatization of the activating and deactivating process of the compacting devices. The sensor unit may comprise a plurality of sensors, each configured to detect an installation start and/or an installation end, and which are allocated to a position of a compacting device. A compacting device can then be activated by the sensor allocated to it when the installation start is detected and deactivated when the installation end is detected.

For simplifying design of the sensor unit, also only one sensor may be provided, which detects the installation start or the installation end. The activation or deactivation of the individual compacting devices can then occur after expiration of a time period, which is calculated as described below.

It is in particular advantageous, if the sensor unit comprises a temperature sensor, a pyrometer, an infrared sensor, an ultrasonic sensor and/or a path sensor. The installation start or the installation end, thus, may be detected by means of a temperature difference. For example, the detection by means of temperature differences is conceivable between road surfaces, which are already laid and which are still to be laid, between two or more already laid surface sections or layers or between already laid road surface and the load-bearing ground.

The disclosure may also relate to a road finisher. Such a road finisher according to the disclosure has a screed assembly of the above described type and a tractor configured to tow the screed assembly.

It is advantageous if the first direction corresponds to a direction of travel of the road finisher.

Moreover, it is conceivable that the control unit is configured to calculate the time period, based on a driving speed of the road finisher.

It is further conceivable that a distance in the direction of travel of the road finisher defined between the first and the second compacting device is provided, and that the time period corresponds to a time required by the road finisher to cover a distance, the length of which corresponds to said distance, with one driving speed.

The control unit, for example, may be provided on the tractor. This can be a central control unit of the road finisher, which is set up for the control of several functions and, in addition to these functions, can also take over the activation and/or deactivation of the compacting devices according to the disclosure. Moreover, it is conceivable that the control unit is a separate control unit for controlling the functions according to the disclosure. This may, for example, be provided on the tractor, but also on the screed assembly.

The disclosure furthermore relates to a method for operating a screed assembly for the use at a road finisher. Such a method comprises the following steps: activating and/or deactivating a first compacting device of the screed assembly, activating and/or deactivating a second compacting device of the screed assembly, which is arranged behind the first compacting device in the direction of travel of the road finisher, after expiration of a predetermined time period, which is unequal to zero. As already described above, the first as well as the second compacting device may be tamper bars, vibration units and/or pressure bars. A screed segment may comprise any combinations of such compacting devices, for example only one or more vibration unit/s, tamper and vibration unit/s, tamper and 1 or 2 pressure bars or tamper, vibration unit/s and 1 or 2 pressure bars.

It is advantageous, if the time period is calculated based on a driving speed of the road finisher. The driving speed of the road finisher can, for example, be detected and determined by a sensor unit.

Furthermore, it is conceivable that the time period is calculated based on a distance defined in the direction of the road finisher between the compacting devices.

An installation start and/or installation end may as well be detected by a sensor unit. As already mentioned, thereby, a further automatization of the activating or deactivating process of the compacting devices may be enabled. The sensor unit may comprise a plurality of sensors, each configured to detect an installation start and/or an installation end, and which are allocated to a position of a compacting device. A compacting device can then be activated by the sensor allocated to it when the installation start is detected and deactivated when the installation end is detected.

For simplifying design of the sensor unit, also only one sensor may be provided, which detects the installation start or the installation end. The activation or deactivation of the individual compacting devices can then occur after expiration of a time period, which is calculated as described above. The sensor unit may comprise a temperature sensor, a pyrometer, an infrared sensor, an ultrasonic sensor and/or a path sensor.

It is moreover advantageous, if an installation start and/or an installation end is detected by means of a temperature difference. For example, the detection by means of temperature differences is conceivable between road surfaces, which are already laid and which are still to be laid, between two or more already laid surface sections or layers or between already laid road surface and the load-bearing ground.

In a further alternative, the first compacting device may be provided at a first screed segment of the screed assembly and the second compacting device at a second screed segment of the screed assembly, which is arranged behind the first screed segment in the direction of travel of the road finisher.

The disclosure relates to a screed assembly as well as to a method as described above. In the following, embodiments are explained in more detail with reference to the attached drawings.

BRIEF DESCRIPTION OF THE DRAWINGS

FIG. 4 is a schematic presentation of two screed segments in top view from above in order to explain distances.

DETAILED DESCRIPTION

As required, detailed embodiments are disclosed herein; however, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
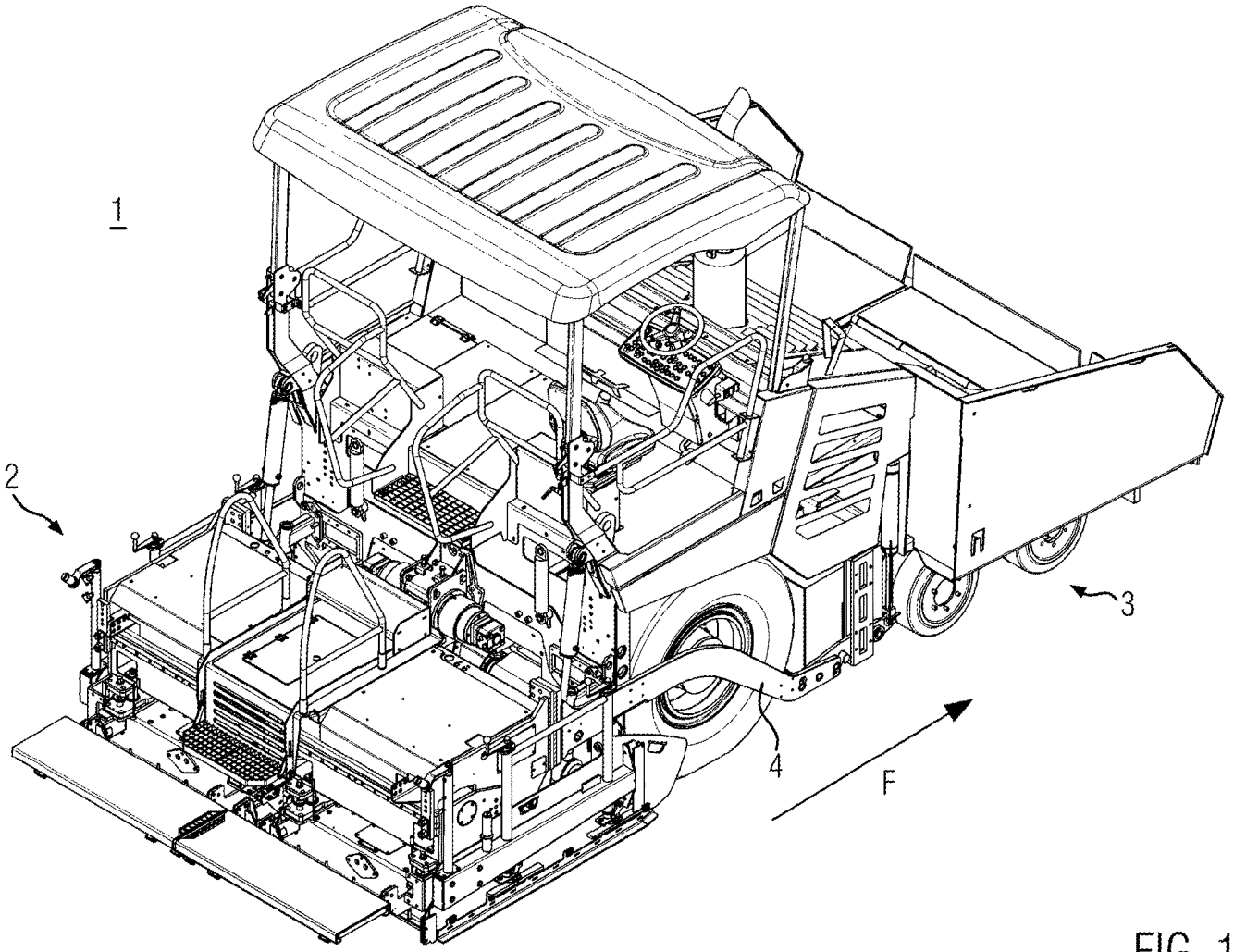
FIG. 1 shows a road finisher with a screed assembly according to the disclosure.

FIG. 1 shows a road finisher 1 comprising a screed assembly 2 and a tractor 3. The tractor may, for example, be connected to the screed assembly 2 by tension arms 4. Thereby, the screed assembly 2 may be pulled floating and may, thus, smooth and compact an asphalt layer to be laid. In FIG. 1, moreover, a driving direction F is shown, in which the road finisher 1 moves.

Figure 2:
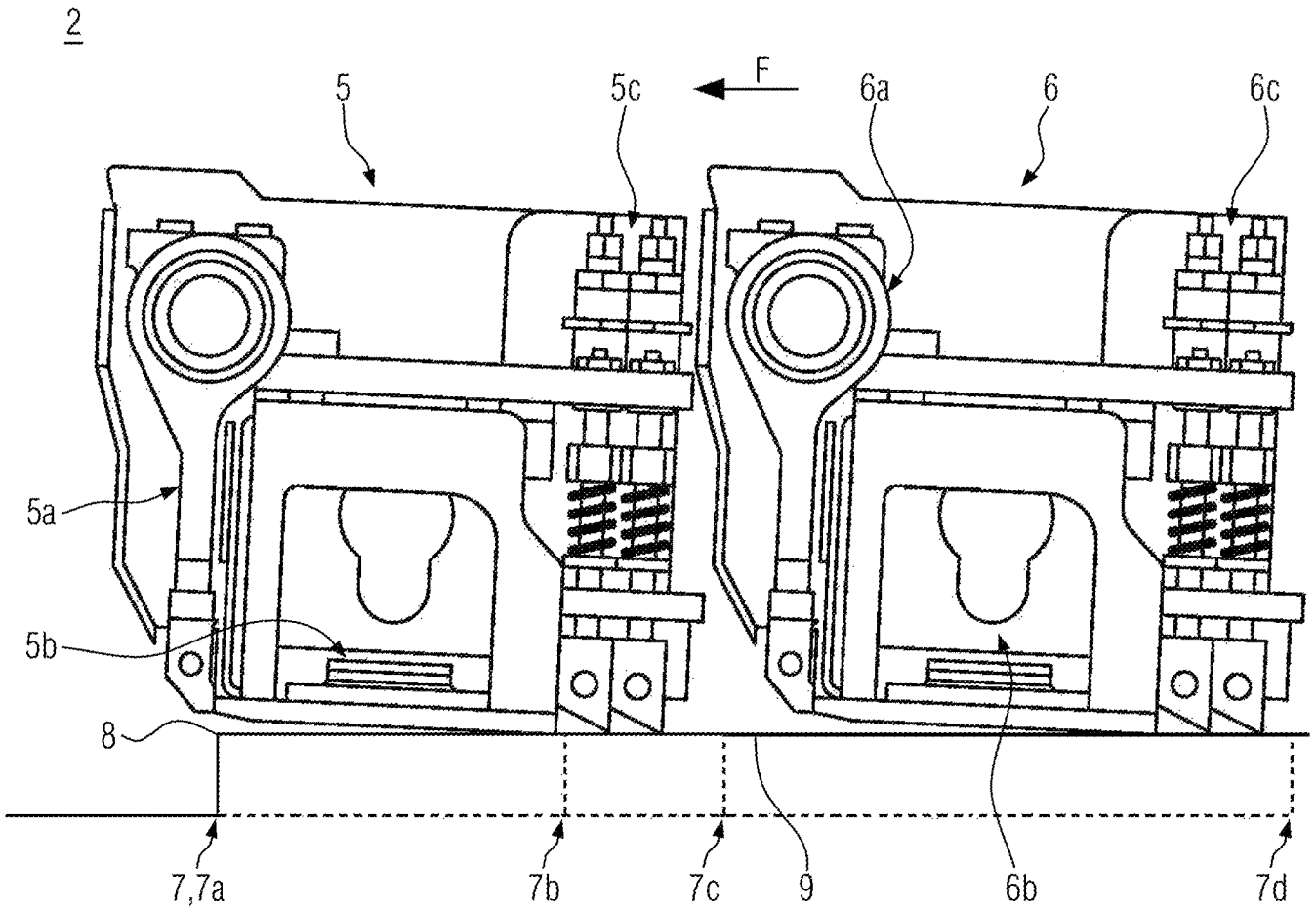
FIG. 2 shows a schematic side sectional view of a screed assembly with two screed segments, each having a plurality of compacting devices.

In FIG. 2, it can be seen that the screed assembly 2 comprises a first screed segment 5 and a second screed segment 6. The second screed segment 6 is arranged in the direction of travel F behind the first screed segment 5, i.e., the first screed segment 5 always reaches an installation section to be worked before the second screed segment 6. The screed assembly 2 may for example be an extendable screed. In the present embodiment, the first screed segment 5 is non-extendable and the second screed segment 6 is extendable. However, it is conceivable that the first screed segment is extendable and the second screed segment 6 is non-extendable. In a further alternative, both screed segments 5, 6 may be extendable. To a person skilled in the art, it is common that extendable screed segments 5, 6 are extendable in a lateral direction essentially perpendicular to the direction of travel of the road finisher 1. Referring to FIG. 2, this would correspond to an extension perpendicular to the drawing plane. In the present embodiment, the first screed segment 5 as well as the second screed segment 6 comprise a plurality of compacting devices 5*a*, 5*b*, 5*c*, 6*a*, 6*b*, 6*c*. The first screed segment 5 comprises a first tamper 5*a*, a first vibration unit 5*b*, as well as a first pressure bar set 5*c*. The second screed segment 6 comprises a second tamper 6*a*, a second vibration unit 6*b*, as well as a second pressure bar set 6*c*. The first pressure bar set 5*c* as well as the second pressure bar set 6*c* may comprise one or more pressure bars. It is also conceivable that both screed segments 5 and 6 each comprise only one or more of such compacting devices 5*a*, 5*b*, 5*c*, 6*a*, 6*b*, 6*c*. Also different configurations of the individual screed segments 5, 6 are conceivable.

In the present embodiment, all of said compacting devices 5*a*, 5*b*, 5*c*, 6*a*, 6*b*, 6*c*, except the pressure bar set 6*c*, may be regarded as first compacting device according to the disclosure. Analogously, all of said compacting devices 5*a*, 5*b*, 5*c*, 6*a*, 6*b*, 6*c*, except of the tamper 5*a*, may be regarded as second compacting device according to the disclosure. According to the disclosure, the screed segments 5, 6 as well as the compacting devices 5*a*, 5*b*, 5*c*, 6*a*, 6*b*, 6*c* pass an installation start 7 one after the other. The installation start 7 may, for example, be defined by an edge 8, which is provided at an already laid asphalt layer 9. In cases, in which an already laid installation layer 9 is not yet available, for example an aid, such as a wooden beam may be used for applying the screed assembly 2. The installation start 7 is shown in FIG. 2 in different positions 7*a*, 7*b*, 7*c*, 7*d* relative to the screed assembly 2.

Before starting the installation run, the tractor 3 and, consequently, the screed assembly 2 are positioned in a way that a compacting device 5*a*, 5*b*, 5*c*, 6*a*, 6*b*, 6*c* located furthest in the front in the direction of travel F, in the present embodiment the tamper 5*a*, is arranged at the installation start 7. In FIG. 2, this corresponds to the positioning 7*a*. Thereby, the screed assembly 2 may essentially be applied to the already laid asphalt layer 9 or to the aid.

According to the present disclosure, with the start of the installation run, an operator of the road finisher 1 may now initialize the activation of the compacting devices 5*a*, 5*b*, 6*c*, 6*a*, 6*b*, 6*c*, for example by pressing a button. Then, the tamper 5*a* is activated first. This may, for example occur directly after the initialization, or when the tractor 3 starts to move. After expiration of a predetermined time period T, without further intervention by the operator, the vibration unit 5*b* is activated. In FIG. 2, this may correspond to the positioning 7*b*. Analogously to this, the further compacting devices 5*a*, 5*b*, 5*c*, 6*a*, 6*b*, 6*c* are successively activated. The time period T is thereby selected such that the respective compacting device 5*a*, 5*b*, 5*c*, 6*a*, 6*b*, 6*c* is activated when the installation start 7 is passed.

Figure 5:
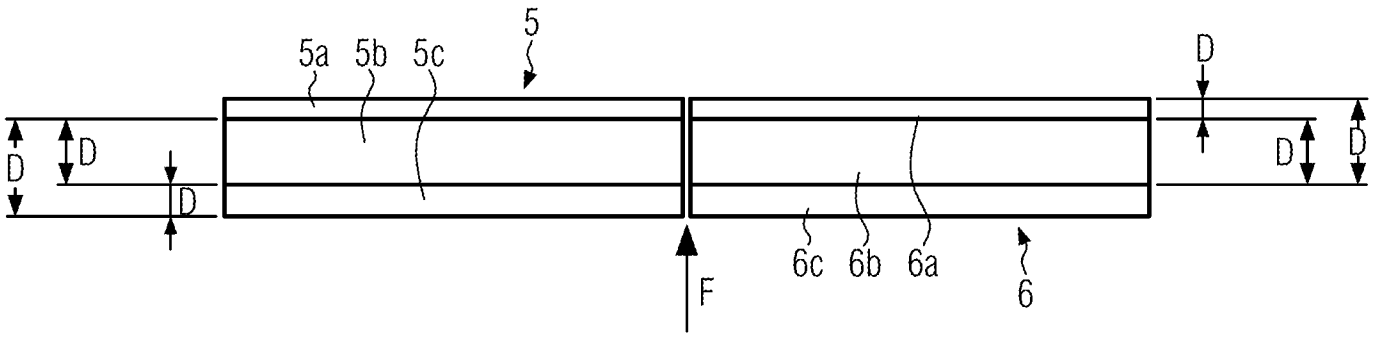
FIG. 5 is a schematic presentation of two screed segments in top view from above.

If the screed segments 5, 6 are arranged next to one another in alignment, also the respective compacting devices may be arranged in alignment with one another (see FIG. 5). The compacting devices aligned with one another may then each be activated simultaneously, i.e., firstly, the compacting devices 5*a* and 6*a* are simultaneously activated, then the compacting devices 5*b* and 6*b* and finally, the compacting devices 5*c* and 6*c*. Aligning compacting devices may, for example, be provided in the following configurations: it is conceivable that both screed segments 5, 6 are provided in one and the same basic screed. It is furthermore conceivable that one of the screed segments 5, 6 is provided on a rigid basic screed and the other on a rigid or extendable broadening and/or attachment part attached to this basic screed. In addition, one of the screed segments 5, 6 may be provided on an extendable basic screed and the other on a broadening and/or attachment part attached thereto.

In a further alternative, it is conceivable that for example to facilitate a control circuit, the compacting devices 5*a*, 5*b*, 5*c*, 6*a*, 6*b*, 6*c* of a respective screed segment 5, 6 can only be activated together. In this case, the compacting devices 5*a*, 5*b*, 5*c* of the first screed segment 5 are activated at the start of the installation run. This may for example occur, if the positioning 7*c* is present according to FIG. 2. After expiration of a time period T1, the compacting devices 6*a*, 6*b*, 6*c* of the second screed segment 6 are activated. In this case, the time period T1 is selected such that the compacting devices 6*a*, 6*b*, 6*c* of the second screed segment 6 are activated when the installation start 7 is passed, for example, if the positioning 7*d* according to FIG. 2 is present.

In this way, suitable time periods T may be provided between the times of activation of any number of different compacting units 5*a*, 5*b*, 5*c*, 6*a*, 6*b*, 6*c* arranged one behind the other in the direction of travel F. Thereby, it can be ensured that the individual compacting devices 5*a*, 5*b*, 5*c*, 6*a*, 6*b*, 6*c* each are activated when the installation start 7 is passed. An analogous procedure can be provided for the deactivation at an installation end.

The time period T between the activation times of two compacting devices 5*a*, 5*b*, 5*c*, 6*a*, 6*b*, 6*c* may thereby be calculated based on a driving speed of the road finisher 1 in the direction of travel F and/or on a distance D (see FIG. 4) between the respective compacting devices 5*a*, 5*b*, 5*c*, 6*a*, 6*b*, 6*c*. In embodiments, in which the compacting devices 5*a*, 5*b*, 5*c*, 6*a*, 6*b*, 6*c* are activated according to grouped screed segments 5, 6, the distance D may also be defined between the screed segments 5, 6.

Figure 3A:
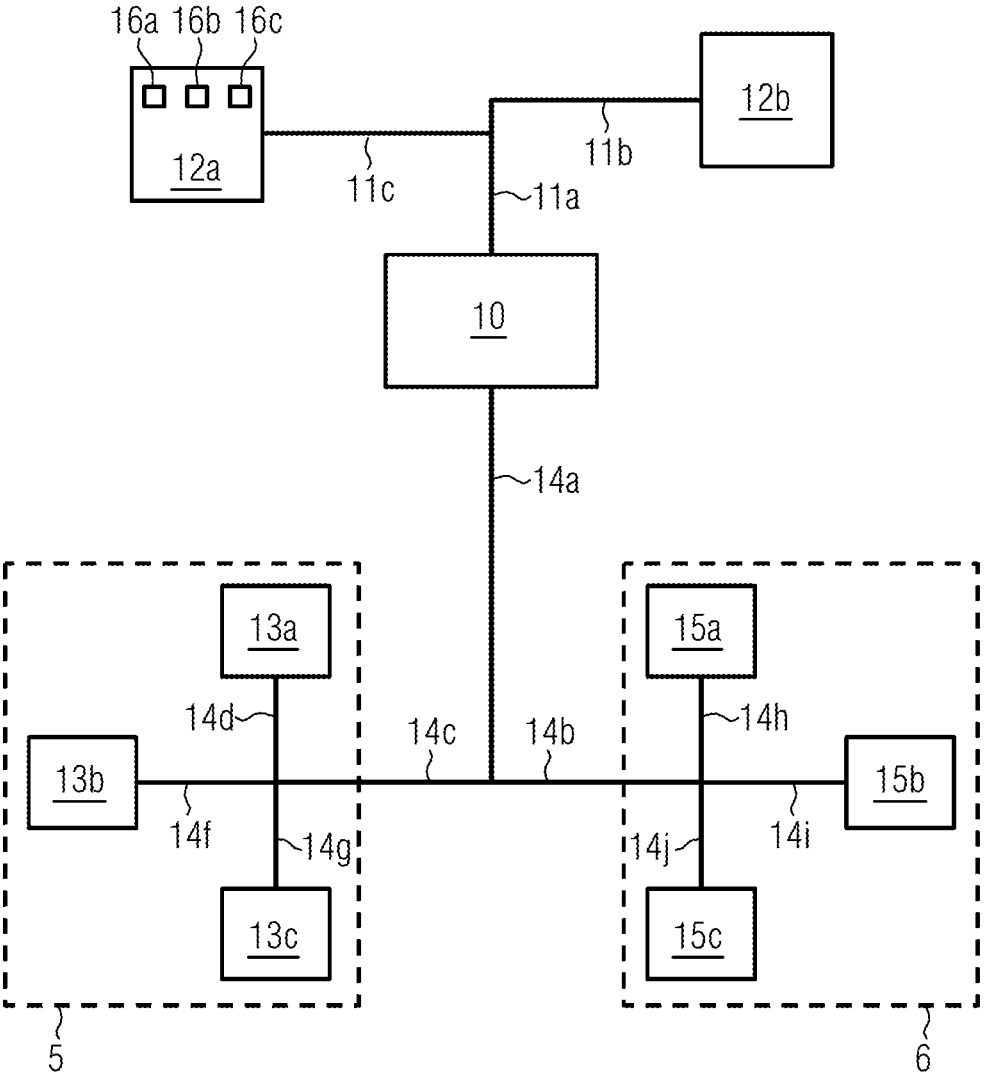
FIGS. 3A and 3B show schematically the connections between a control unit and compacting devices of two screed segments according to two different embodiments.
Figure 3B:
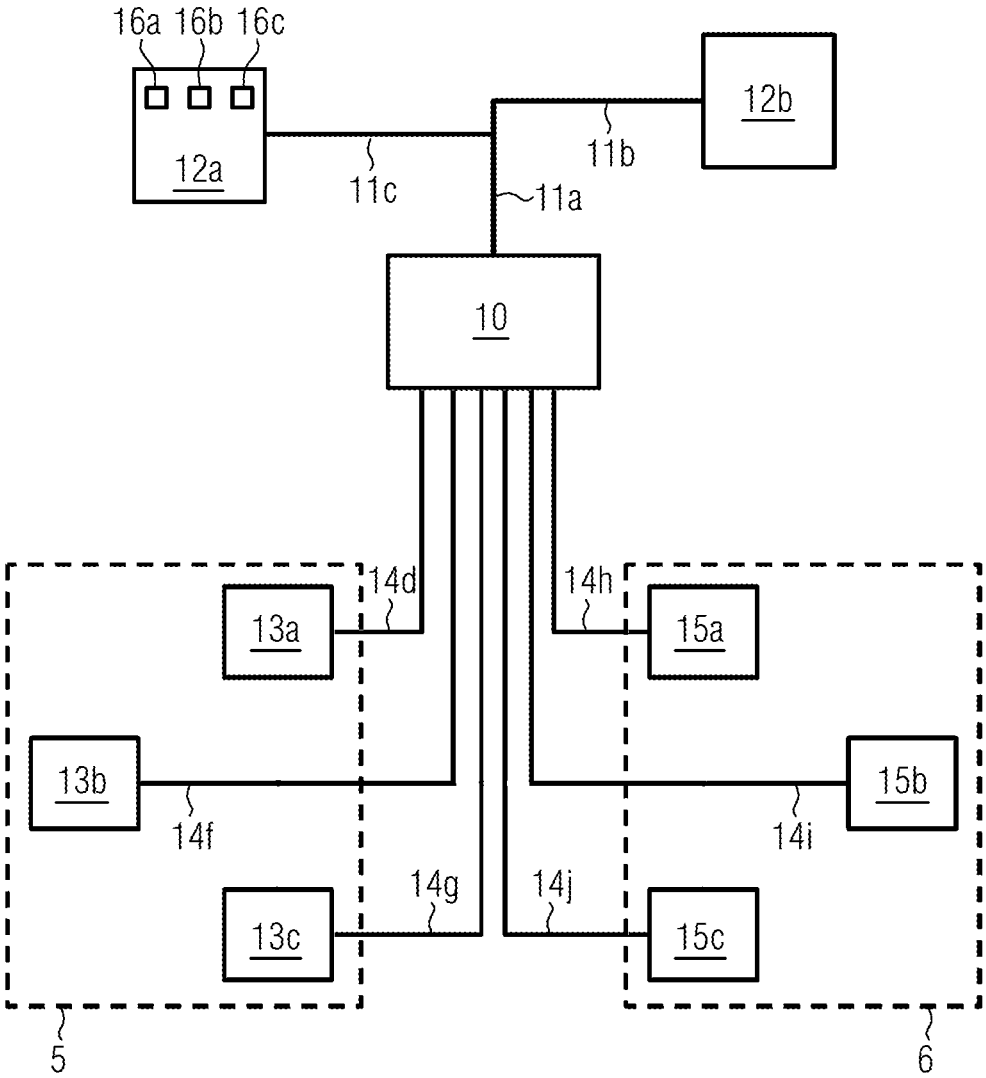

In FIGS. 3A and 3B, the connection between different components of the road finisher 1 and, in particular, of the screed assembly 2 is schematically shown. The control unit 10 can be seen. The control unit 10 may be provided on the road finisher 1 or on the screed assembly 2. It is connected to input devices 12 via first control lines 11. The input devices 12 may, for example, be a sensor unit 12*a* or an operating device 12*b*.

The sensor unit 12*a* may, for example, be configured to detect the driving speed of the road finisher 1 or to determine the same by means of other parameters, which can be detected by it. It is also conceivable that the control unit 12*a* is configured to detect the installation start 7 and/or the installation end, for example, by detecting the edge 8. This may, for example, occur by height sensors, which are already provided on the road finisher, such as used, for example for levelling. The sensor unit 12*a* can furthermore be configured to detect if and/or when the tractor 3 or the road finisher 1 start to move. A plurality of sensor units, which are configured for different purposes, is also conceivable.

The sensor unit 12*a* or the sensor units 12*a* may also comprise for example one or more temperature sensors, pyrometers, infrared sensors, ultrasonic sensors and/or path sensors. The installation start 7 or the installation end may then be detected, for example by means of an infrared sensor or a pyrometer on the basis of a temperature difference between the already laid layer and the layer still to be laid. The sensor unit 12*a* can comprise one or more sensors 16.

For example, sensors 16*a*, 16*b*, and 16*c* can be provided and configured to detect the installation start 7 or the installation end. Each of the sensors 16*a*, 16, and 16*c* may be allocated to the position of one or more of the compacting devices 5*a*, 5*b*, 5*c*, 6*a*, 6*b*, 6*c*. If one of the sensors 16*a*, 16*b*, 16*c* detects the installation start 7, the compacting device/s 5*a*, 5*b*, 5*c*, 6*a*, 6*b*, 6*c* allocated to it can be activated. When the installation end is detected, the compacting device/s 5*a*, 5*b*, 5*c*, 6*a*, 6*b*, 6*c* allocated to it can correspondingly be deactivated.

The operating device 12*b* may be configured to accept user data from the operator of the road finisher 1 or of the screed assembly 2. Similar to the control unit 10, it may be provided on both, the tractor 3 and the screed assembly 2. It is also conceivable that the operating device 12*b* and the control unit 10 are arranged in one and the same housing. However, an arrangement in different housings is also conceivable.

The control unit 10 may be a control unit 10, which is provided specifically for the control of the compacting devices 5*a*, 5*b*, 5*c*, 6*a*, 6*b*, 6*c*. However, it is also possible that the control unit 10 is also provided for the control of further functions of the road finisher 1.

The first screed segment 5 and the second screed segment 6 are indicated by broken lines. The screed segment 5 comprises a tamper drive unit 13*a*, a vibration drive unit 13*b*, and a pressure bar drive unit 13*c*. The tamper drive unit 13*a* may, for example, comprise an eccentric shaft, which, for example, may be actuated by means of a hydraulic motor or an electric motor. The vibration drive unit 13*b* may, for example, comprise an unbalance shaft, which, for example, may be actuated by means of a hydraulic motor or an electric motor. The pressure bar drive unit 13*c* may, for example, comprise a pulsed-flow hydraulic drive. A drive by means of electric actuators is also conceivable. The control unit 10 is connected to the drive units 13 of the first screed segment 5 via second control lines 14. The second screed segment 6 in the present embodiment, analogously to the first screed segment, comprises a tamper drive unit 15*a*, a vibration drive unit 15*b*, as well as a pressure bar drive unit 15*c*. These may be configured analogously to the drive units 13 of the first screed segment 5 and can be connected to the control unit 10.

In the present embodiment, two screed segments 5, 6 are provided, which each comprise three different compacting devices 5*a*, 5*b*, 5*c*, 6*a*, 6*b*, 6*c* and the associated drive units 13, 15. However, screed assemblies 2 are conceivable with any number of screed segments, for example only one screed segment or more than two screed segments. An individual screed segment or several screed segments each may also comprise arbitrarily different combinations of compacting devices 5*a*, 5*b*, 5*c*, 6*a*, 6*b*, 6*c*.

The control unit 10 may be an electrical control unit, a hydraulic control unit or an electro-hydraulic control unit. Accordingly, the control lines 11, 14 may be configured, i.e., they may be electrical as well as hydraulic control lines. In particular, the control lines 11 may be electrical lines. The control lines 14 may be configured depending on the type of the drive unit connected thereto. A control line 14, which is connected to a hydraulic drive unit 13, 15, may also be a hydraulic control line 14.

The control lines 14, as shown in FIG. 3A, may be branched control lines. These may be connected at a central connecting point, for example an output of the control unit 10, and then branch out correspondingly to the drive units 13, 15. According to FIG. 3B, however, for each drive unit 13, 15, a separate control line 14 may be provided. Furthermore, it is conceivable that for a first group of drive units, a branched control line 14 is provided, which connects a plurality of drive units from precisely this group to a connection of the control unit 10, and a second group of drive units, each connected to the control unit 10 by a separate control line 14.

Furthermore, as one skilled in the art would understand, the control unit 10 may include suitable hardware and software, such as one or more processors (e.g., one or more microprocessors, microcontrollers and/or programmable digital signal processors) in communication with, or configured to communicate with, one or more storage devices or media including computer readable program instructions that are executable by the one or more processors so that the control unit may perform particular algorithms represented by the functions and/or operations described herein. The control unit 10 may also, or instead, include one or more application specific integrated circuits, programmable gate arrays or programmable array logic, programmable logic devices, or digital signal processors.

The time periods T, T1 may be determined based on a distance D between the respective compacting devices 5*a*, 5*b*, 5*c*, 6*a*, 6*b*, 6*c* or screed segments 5, 6. The distance D may be defined in the direction of travel F. It can be defined in pairs between individual compacting devices 5*a*, 5*b*, 5*c*, 6*a*, 6*b*, 6*c* or screed segments 5, 6, or with respect to the compacting device 5*a* located furthest in the front or with respect to the screed segment 5 located furthest in the front, respectively. Moreover, it may be defined between the front ends of the corresponding compacting devices 5*a*, 5*b*, 5*c*, 6*a*, 6*b*, 6*c*, screed segments 5, 6, respectively, as shown in FIG. 4 right-hand side, or between the back end of the compacting devices 5*a*, 5*b*, 5*c*, 6*a*, 6*b*, 6*c* or screed segments 5, 6, as shown in FIG. 4 left-hand side. The same applies to distances D between screed segments 5, 6.

While exemplary embodiments are described above, it is not intended that these embodiments describe all possible forms according to the disclosure. In that regard, the words used in the specification are words of description rather than limitation, and it is understood that various changes may be made without departing from the spirit and scope of the disclosure. Additionally, the features of various implementing embodiments may be combined to form further embodiments according to the disclosure.

What is claimed is:

1. A screed assembly for use at a road finisher, the screed assembly comprising:

a control unit;

a first compacting device; and a second compacting device, which is arranged in a first direction behind the first compacting device;

wherein the control unit is configured to activate and/or deactivate the second compacting device in a delayed manner relative to the first compacting device by a time period, which is unequal to zero, so that the second compacting device may be changed from an inactive state to an active state or from an active state to an inactive state in a delayed manner relative to the first compacting device.

2. The screed assembly according to claim 1 wherein the screed assembly comprises a first screed segment and a second screed segment, wherein the second screed segment is arranged in the first direction behind the first screed segment, and wherein the first screed segment comprises the first compacting device and the second screed segment comprises the second compacting device.

3. The screed assembly according to claim 1 further comprising a sensor unit configured to detect an installation start and/or an installation end.

4. The screed assembly according to claim 3 wherein the sensor unit comprises a temperature sensor, a pyrometer, an infrared sensor, an ultrasonic sensor and/or a path sensor.

5. A road finisher comprising the screed assembly according to claim 1 and a tractor, which is configured to tow the screed assembly.

6. The road finisher according to claim 5 wherein the first direction corresponds to a direction of travel of the road finisher.

7. The road finisher according to claim 5 wherein the control unit is configured to calculate the time period based on a driving speed of the road finisher.

8. The road finisher according to claim 6 wherein a distance in the direction of travel of the road finisher defined between the first and second compacting devices is provided, and the time period corresponds to a time required by the road finisher to cover a distance, the length of which corresponds to the distance between the first and second compacting devices, with a driving speed.

9. The road finisher according to claim 5 wherein the control unit is provided at the tractor.

10. A method for operating a screed assembly of a road finisher, the method comprising:

activating and/or deactivating a first compacting device of the screed assembly; and activating and/or deactivating a second compacting device of the screed assembly, which is arranged in a direction of travel of the road finisher behind the first compacting device, after expiration of a predeterminable time period, which is unequal to zero, so that the second compacting device is changed from an inactive state to an active state or from an active state to an inactive state in a delayed manner relative to the first compacting device.

11. The method according to claim 10 wherein the time period is calculated based on a driving speed of the road finisher.

12. The method according to claim 10 wherein the time period is calculated based on a distance defined in the direction of travel of the road finisher between the compacting devices.

13. The method according to claim 10 wherein an installation start and/or an installation end are/is detected by a sensor unit.

14. The method according to claim 10 wherein an installation start and/or an installation end are/is detected by means of a temperature difference.

15. The method according to claim 10 wherein the first compacting device is provided at a first screed segment of the screed assembly and the second compacting device is provided at a second screed segment of the screed assembly, which is arranged in the direction of travel of the road finisher behind the first screed segment.

16. The method according to claim 10 wherein the road finisher comprises a tractor to tow the screed assembly, and wherein the activating and/or deactivating the first compacting device and the activating and/or deactivating the second compacting device are performed by a control device that is provided at the tractor.

17. The method according to claim 10 wherein the activating and/or deactivating the first compacting device and the activating and/or deactivating the second compacting device are performed by a control device that is provided on a portion of the road finisher.

18. The method according to claim 10 wherein a distance in the direction of travel of the road finisher defined between the first and second compacting devices is provided, and the time period corresponds to a time required by the road finisher to cover a distance, the length of which corresponds to the distance between the first and second compacting devices, with a driving speed.

19. A road finisher comprising:

a control unit;

a screed assembly including a first compacting device, and a second compacting device, which is arranged in a first direction of travel of the road finisher behind the first compacting device; and a tractor to tow the screed assembly;

wherein the control unit is configured to activate and/or deactivate the second compacting device in a delayed manner relative to the first compacting device by a time period, which is unequal to zero, and wherein a distance in the direction of travel of the road finisher defined between the first and second compacting devices is provided, and the time period corresponds to a time required by the road finisher to cover a distance, the length of which corresponds to the distance between the first and second compacting devices, with a driving speed.

20. The road finisher according to claim 19 wherein the control unit is provided on the tractor.

21. The road finisher according to claim 19 wherein the control unit is provided on the screed assembly.

* * * * *